US009916951B2

(12) United States Patent
Zhou

(10) Patent No.: US 9,916,951 B2
(45) Date of Patent: Mar. 13, 2018

(54) CONTACTOR, CONTACTOR ASSEMBLY AND CONTROL CIRCUIT

(71) Applicant: Tyco Electronics (Shanghai) Co. Ltd., Shanghai (CN)

(72) Inventor: Xiao Zhou, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 254 days.

(21) Appl. No.: 14/818,556

(22) Filed: Aug. 5, 2015

(65) Prior Publication Data

US 2016/0042899 A1 Feb. 11, 2016

(30) Foreign Application Priority Data

Aug. 5, 2014 (CN) ..... 2014 1 0381422
Aug. 5, 2014 (CN) ..... 2014 1 0381718

(51) Int. Cl.

| | |
|---|---|
| ***H01H 47/22*** | (2006.01) |
| ***H01H 47/04*** | (2006.01) |
| ***H01H 47/32*** | (2006.01) |
| ***H01H 3/00*** | (2006.01) |
| ***H01H 47/00*** | (2006.01) |
| ***H01H 50/44*** | (2006.01) |
| ***H01H 50/18*** | (2006.01) |
| ***H01H 50/04*** | (2006.01) |

(52) U.S. Cl.

CPC ..... *H01H 47/22* (2013.01); *H01H 3/001* (2013.01); *H01H 47/002* (2013.01); *H01H 47/325* (2013.01); *H01H 50/048* (2013.01); *H01H 50/18* (2013.01); *H01H 50/443* (2013.01); *H01H 47/04* (2013.01); *H01H 2047/003* (2013.01); *H01H 2047/008* (2013.01)

(58) Field of Classification Search

CPC ..... H01H 47/22; H01H 3/001; H01H 47/325; H01H 47/04; H01H 47/32; H02H 50/048
USPC ..... 361/159–160
See application file for complete search history.

(56) References Cited

U.S. PATENT DOCUMENTS 5,424,637 A * 6/1995 Oudyn ..... F16H 61/0251 324/207.16
6,023,110 A * 2/2000 Henrion ..... H01H 47/004 307/125
6,377,143 B1 * 4/2002 Zhou ..... H01H 50/546 218/154

(Continued)

*Primary Examiner* — Dharti Patel
(74) *Attorney, Agent, or Firm* — Barley Snyder

(57) ABSTRACT

The present invention relates to a contactor, a connector and a contactor component. According to the first aspect of the invention, a contactor relates to a switch mechanism, an iron core, an iron core position sensing circuit and a control circuit. The control circuit can measure the position of the iron core by measuring the variation in inductance by using the property that the coil can produce different inductances when the iron core is in different positions in the coil. According to the second aspect of the invention, a connector and contactor component are provided, wherein a control circuit is arranged on a connector, the control circuit comprises a PWM power-saving circuit. The PWM power-saving circuit is integrated on the connector, so that the average driving current of the contactor is reduced and meanwhile, the size of the contactor is reduced.

18 Claims, 4 Drawing Sheets

(56) References Cited

U.S. PATENT DOCUMENTS

| | | | | |
|---|---|---|---|---|
| 2013/0140383 | A1* | 6/2013 | Thomas | F01N 3/208<br>239/585.5 |
| 2015/0076904 | A1* | 3/2015 | Mills | H01H 50/54<br>307/29 |

* cited by examiner

CONTACTOR, CONTACTOR ASSEMBLY AND CONTROL CIRCUIT

CROSS-REFERENCE TO RELATED APPLICATIONS

The application claims the benefit of Chinese Patent Application Nos. 201410381422.8 and 201410381718.X filed on Aug. 5, 2014 in China, and which disclosures are incorporated herein by reference. To the extent appropriate, a claim of priority is made to each of the above disclosed applications.

FIELD OF THE INVENTION

The present invention relates to a connector and a contactor assembly, and more specifically to a contactor and a connector for connecting controlling the operation of a coil in the contactor.

BACKGROUND OF THE INVENTION

A contactor or a relay is generally used for switching on and switching off or controlling a working circuit. For example, the contactor is provided with a coil, a moving contact and a fixed contact. When current passes through the coil in the contactor, a magnetic field can be produced to connect the moving contact and the fixed contact, thereby controlling a loaded electric appliance.

Due to frequent connection and disconnection, welding adhesion between the current conduction contacts of a high-voltage and high-current contactor or relay may occur due to overcurrent, high-temperature electric arc destruction or aging after long-term use or other reasons. As a result, the moving contact of the contactor or the relay is out of control and thus fails. For a low-voltage relay or contactor, usually the failure can be directly detected very simply by monitoring the circuit. But for the high-voltage and high-current contactor, it is inconvenient to directly monitor the circuit.

Generally, in the industry, the moving contact end of the contactor is in parallel connection with an auxiliary contact which is insulated and isolated with the main contact such that the connection and disconnection of the main contact is detected by monitoring the connection and disconnection of the auxiliary contact. In addition, in the industry, the position or the connection or disconnection of the main contact is sensed by adding a non-contact type of magnetic Hall switch. Although these approaches are simple for customers to employ, the cost of the contactor and the maintenance cost of a product are relatively high; and furthermore, when high current flows through the relay or the contactor, the magnetic Hall switch is very liable to being interfered by magnetic lines and thus cannot meet the requirement of controlling the contactor. Furthermore, as the control functions of the contactor increase, the requirement on effective control of the contacts is higher.

In most cases, the contactor or the relay is connected with various control circuits for achieving various control functions. For example, for the high-current contactor, in particular to the contactor applied to a mobile device, such as an electric vehicle, the average driving current of the contactor is required to be as low as possible. Generally, an electronic power-saving device is used to meet the requirement. For existing contactors, the electronic device is generally arranged in a contactor or directly attached on the contactor, and is energized to start to work. With such configurations, it is simple for users to use the existing contactors. However, the cost of the existing contactors and the maintenance cost of a product are relatively high. Moreover, when the contactor or the relay is configured with a variety of control circuits, the wiring arrangement and the circuit connection become complex, which causes the cost of the contactor or the relay to increase. In addition, in the development of miniaturization, simplification and universalization of the contactor or the relay, the development of diversification of the control circuit of the contactor or the relay is limited.

SUMMARY OF THE PRESENT INVENTION

The present invention provides two aspects, the first aspect relating to a contactor, a contactor assembly and a control circuit and the second aspect relating to a connector and contactor assembly.

Part I: Summary for the First Aspect

The first aspect of the invention is to solve the problems described above by providing a contactor, a contactor assembly and a control circuit used with the same.

A first objective of the invention is to overcome the shortcomings of the prior art and provide a control circuit, the internal structure of which can be conveniently processed.

In order to realize the objective, the invention is implemented by adopting the following technical solution:

A control circuit for controlling the operation of a contactor, wherein the contactor comprises an iron core and a coil which is wound around the iron core; and the control circuit is characterized in that, the control circuit comprises an iron core position sensing circuit, and the iron core position sensing circuit comprises:

an excitation signal generating circuit which is connected with the coil and can output an excitation signal to the coil and enable the coil to generate an inductance, wherein the coil can generate inductance values varying with different positions of the iron core;

a sensing circuit which is connected with the coil and measures the inductance values produced by the coil; and the sensing circuit determining the positions of the iron core according to different inductance values.

Preferably, the control circuit further comprises a working control circuit. The working control circuit is connected with the coil and provides working current to the coil to close the contactor to switch on a working loop.

Preferably, the excitation signal generating circuit outputs the excitation signal to the coil when the working loop is in a switched-off state.

Preferably, the measured inductance values are compared with a desired value, if a measured inductance value is equal to the desired value or is within a predetermined range of the expected value, it is determined that the iron core is in a normal position; and if a measured inductance value is different from the desired value or exceeds the predetermined range of the desired value, it is determined that the iron core is in an abnormal position.

Preferably, the sensing circuit measures the inductance value of the coil by measuring charging and discharging time and further determines the position of the iron core.

Preferably, the sensing circuit determines the position of the core by measuring a charging and discharging time difference generated by a variation in the inductance produced by the coil.

Preferably, the coil drives the iron core to move back and forth with provided with the working control circuit providing working current.

Preferably, the control circuit further comprises a selection circuit. The selection circuit is connected with the iron core position sensing circuit and the working control circuit. When the selection circuit and the working control circuit are connected, the contactor is kept in a connected state. When the selection circuit and the iron core position sensing circuit are connected, the iron core position sensing circuit senses a change in the inductance value of the coil to determine the position of the iron core.

Preferably, the excitation signal generating circuit is used for sending the excitation signal when the coil changes from an energized state to a de-energized state. The sensing circuit is used for determining the position of the iron core when the coil changes from the energized state to the de-energized state.

Preferably, the iron core is configured with a switch mechanism at its distal end of, and a pair of moving contacts are configured on one side of the switch mechanism.

Preferably, when the coil is energized, the iron core moves to a pair of fixed contacts to connect with the fixed contacts. When the coil is de-energized, the iron core moves away from the fixed contacts to disconnect from the fixed contacts.

Preferably, the sensing circuit determines whether the iron core and the moving contacts are in abnormal positions or in the normal disconnected position base on the inductance changing amount of the coil.

Preferably, the abnormal positions in which the iron core and the moving contacts are located include the position in which the moving contacts are adhered with the fixed contacts.

Preferably, the iron core position sensing circuit and the coil are detachably connected with each other through a connector.

Preferably, the control circuit is arranged on a printed circuit board, and the printed circuit board and the coil are detachably connected with each other through a connector.

A second objective of the invention is to overcome the shortcomings of the prior art and provide a contactor, the internal structure of which can be conveniently processed.

In order to realize the objective, the invention is implemented by adopting the following technical solution:

A contactor comprises a coil, characterized in that the contactor further comprises a control circuit and the control circuit is connected with the coil.

Preferably, the contactor comprises a switch mechanism and an iron core, and the coil is wound around the iron core and drives the iron core to move back and forth to close or open the switch mechanism so as to switch on or switch off a working loop.

A third objective of the invention is to overcome the shortcomings of the prior art and provide a contactor component, the internal structure of which can be conveniently processed.

In order to realize the objective, the invention is implemented by adopting the following technical solution:

A contactor component, comprising the contactor and a connector. The control circuit is arranged on the connector and connected with the connector as a single piece.

Preferably, the control circuit is arranged on a printed circuit board, and the printed circuit board is mounted on the connector.

Preferably, the connector is connected with the coil through plug-in pieces.

Part II: Summary for the Second Aspect

The second aspect of the invention is to solve the problems described above by providing a connector and contactor assembly.

A fourth objective of the invention is to overcome the shortcomings of the prior art and provide a connector, the internal structure of which can be conveniently processed.

In order to realize the objective, the invention is implemented by adopting the following technical solution:

A connector is configured with a control circuit connectable to a coil in a contactor for controlling the operation of the contactor. The control circuit comprises a working control circuit for providing working current to the contactor. The connector is characterized in that, the working control circuit comprises:

a PWM power-saving circuit connected with the contactor;

when the contactor is being connected, the PWM power-saving circuit provides a signal with a preset duty ratio to the contactor; and after the contactor is connected, the PWM power-saving circuit provides a signal with a smaller duty ratio to the contactor to maintain a connected state of the contactor, thereby reducing power consumption.

Preferably, the connector further comprises a controller connected with the control circuit for controlling the operation of the control circuit.

Preferably, the connector further comprises an iron core position sensing circuit for producing a signal sensing a position of an iron core in the contactor. The controller processes the signal generated at the iron core position sensing circuit which indicates the sensed position of the iron core, to generate a signal indicating a position state of the iron core and output the signal indicating the position state of the iron core through the I/O bus.

Preferably, the connector further comprises a selection circuit, connected with the controller and controlled by the controller. The selection circuit is connected with the coil, and the selection circuit is connected with the iron core position sensing circuit and the working control circuit, so that the selection circuit selects the iron core position sensing circuit or the working control circuit to connect with the coil at different time.

Preferably, the connector further comprises an I/O (input/output) bus connected with the controller to enable the controller to communicate with the external. The controller processes a signal generated at the iron core position sensing circuit which indicates the sensed position of the iron core to produce a position state signal of the iron core and outputting the position state signal of the iron core through the I/O bus.

Preferably, the I/O bus comprises an LIN bus.

Preferably, the iron core position sensing circuit comprises:

an excitation signal generating circuit which is connected with the coil and can output an excitation signal to the coil and enable the coil to generate an inductance, wherein the coil can produce inductance values varying with different positions of the iron core;

a sensing circuit connected with the coil for measuring the inductance value generated by the coil; and the sensing circuit determines the different positions of the iron core based on the different inductance values.

Preferably, the controller controls the excitation signal generating circuit and outputs the excitation signal to the coil when a working loop is switched off.

Preferably, a desired inductance value is stored in the sensing circuit, and the measured inductance value is compared with the desired value, if the measured inductance value is equal to the desired value or is in a predetermined range of the desired value, it is determined that the iron core is in a normal position; and if the measured inductance value is different from the desired value or exceeds the predetermined range of the desired value, it is determined that the iron core is in an abnormal position.

Preferably, the sensing circuit measures the inductance value of the coil to further determine the position of the iron core by measuring the charging and discharging time.

Preferably, the sensing circuit measures a charging and discharging time difference formed due to a variation in inductances generated by the coil to determine the position of the iron core.

Preferably, the control circuit is arranged on a printed circuit board, and the printed circuit board is mounted on the connector.

Preferably, the control circuit is detachably connected with the coil through the connector.

Preferably, the connector is connected with the coil through plug-in pieces.

A fifth objective of the invention is to overcome the shortcomings of the prior art and provide a connector and contactor assembly, the internal structure of which can be conveniently processed.

In order to realize the objective, the invention is implemented by adopting the following technical solution:

A connector and contactor assembly comprises a contactor comprising a coil, and the connector and contactor assembly is characterized in that, the contactor further comprises the connector, and the control circuit is connected with the coil.

Preferably, the contactor comprises a contactor housing configured with wiring ends for connecting to a working loop.

Preferably, the contactor comprises an iron core configured with a switch mechanism at the distal end; and the coil is wound around the iron core and is used for driving the iron core to move back and forth so as to close or open the switch mechanism to switch on or switch off the working loop.

Preferably, the iron core is configured with a pair of moving contacts at its the distal end, and the working loop is configured with a pair of fixed contacts. When the coil is energized, the iron core moves to the pair of fixed contacts to connect with the fixed contacts. When the coil is de-energized, the iron core moves away from the fixed contacts to disconnect from the fixed contacts.

Preferably, the sensing circuit determines that the iron core and the moving contacts are in abnormal positions or in a normal position disconnected from the fixed contacts based on the variation in the inductance of the coil.

Preferably, the abnormal positions in which the iron core and the moving contacts are located include the position in which the moving contacts are adhered with the fixed contacts.

The beneficial technical effects of the present invention include, but are not limited to:

1. The present invention senses the position of the iron core by measuring the variation in inductance by utilizing the character that the coil can generate different inductances when the iron core is in different positions in the coil, thus, the circuit structure is simple, and the sensing result is accurate.

2. The excitation signal generating circuit in the present invention outputs the excitation signal to the coil each time the working loop enters into the switched-off state, and the sensing circuit senses the position of the iron core to determine whether the contacts are adhered or not, thereby enhancing the reliability of the contactor.

3. According to the present invention, the working control circuit is arranged on the connector instead of being arranged on or in the contactor, thereby avoiding electromagnetic interference on a working circuit in the contactor, releasing the limited space of the contactor, improving the protection level of the whole contactor, reducing physical limitations on the contactor, enhancing the heat dissipation of the contactor and reducing the size of the contactor.

4. According to the present invention, the iron core position sensing circuit and the working control circuit are provided, and a working state and a detection state of the contactor can be controlled through the selection circuit, thereby ensuring that the contactor is in a safe working state.

5. According to the present invention, an I/O (input/output) bus (such as an LIN bus transfer protocol and the like) is integrated on the connector, thereby not only the various circuits in the control circuit can communicate with each other, but also the effective communication between the contactor and the external is achieved and the integration of other applications is easy to be performed.

6. According to the present invention, the PWM power-saving circuit is integrated on the connector, thereby reducing the average driving current of the contactor and meanwhile, reducing the size of the contactor.

BRIEF DESCRIPTION OF THE DRAWINGS

The following description is set forth in connection with the attached drawing figures, which are not necessarily to scale, emphasis instead generally being placed upon illustrating the principles of the invention. In the drawing figures.

DETAILED DESCRIPTION OF THE EMBODIMENTS

Figure 1:
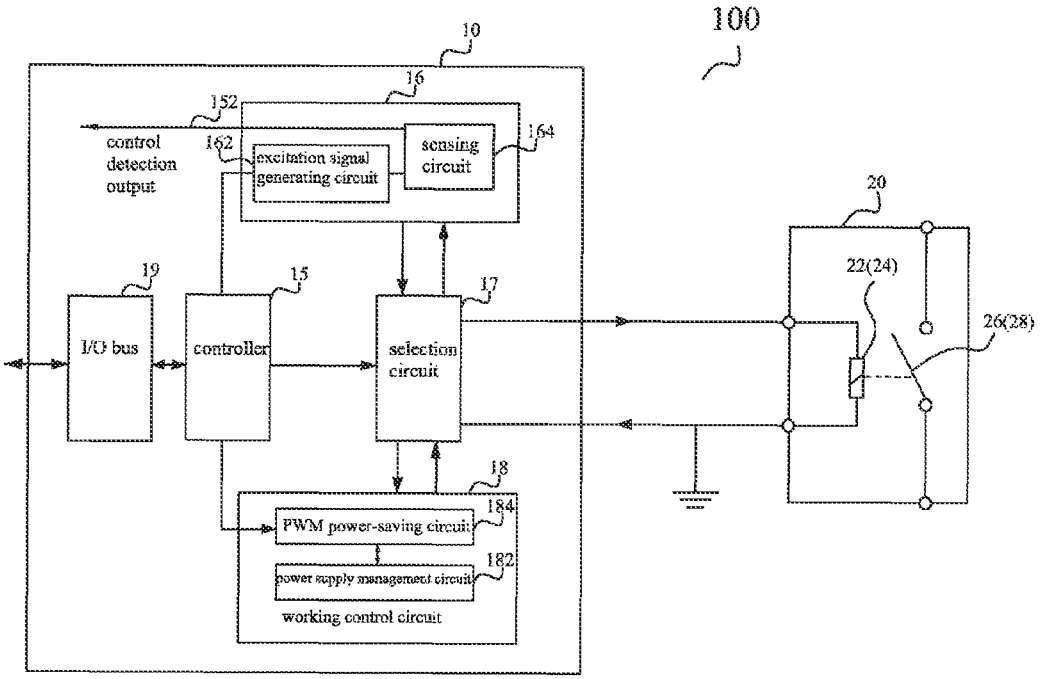
FIG. 1 is a schematic diagram of a circuit structure of a contactor 20 in the first embodiment of the invention.

The present invention will be described in detail by referring to the specific embodiments, and the examples are as shown in the accompanying drawings. In the detailed description of the specific embodiments, the directional terms, such as "top", "bottom", "above", "below", "left", "right" and the like, are used by referring to the directions described in the accompanying drawings. As the parts in the embodiments of the present invention can be set to be in many different directions, the directional terms are used for auxiliary illustration rather than limitation. As far as possible, the same or the similar reference numerals in all the accompanying drawings represent the same or similar parts.

FIG. 1 is a schematic diagram of a circuit structure of a contactor 20 in the first embodiment of the invention.

Figure 3A:
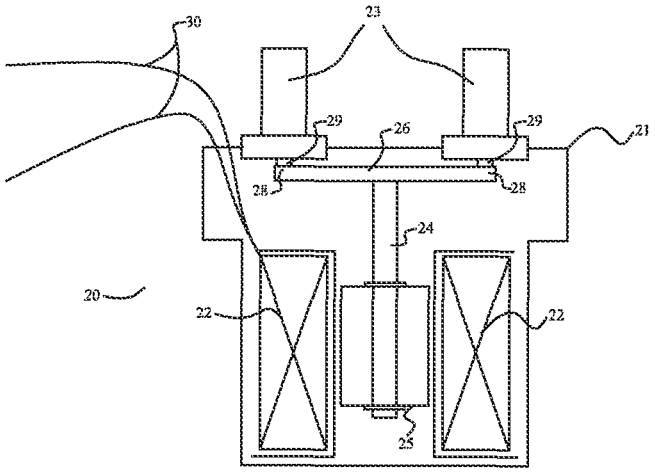
FIG. 3A is a schematic diagram of an internal structure of the contactor when the moving and fixed contacts of the contactor 20 of the invention are connected with each other.
Figure 3B:
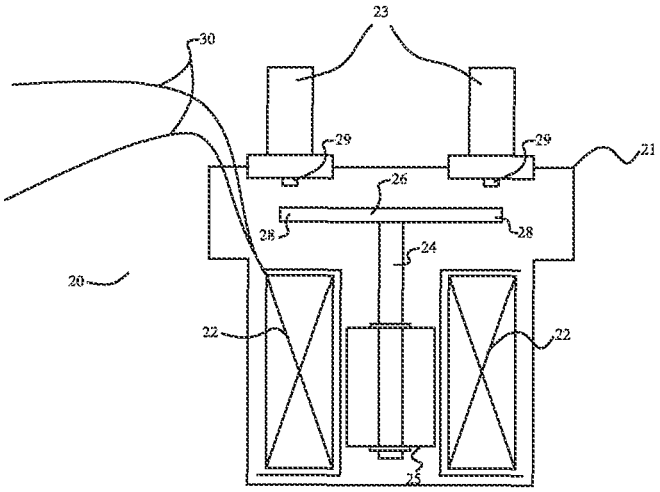
FIG. 3B is a schematic diagram of an internal structure of the contactor when the moving and the fixed contacts of the contactor 20 of the invention are disconnected.

As shown in FIG. 1, a contactor (or relay) 20 comprises a control circuit 10 connected with the contactor 20. The contactor 20 has a contactor housing 21 (as shown in FIGS. 3A-3B) configured with wiring terminals 23 for connecting to a working loop. A coil 22, an iron core 24, a switch mechanism 26, moving contacts 28 and fixed contacts 29 are arranged in the housing 21. The fixed contacts 29 are connected with the wiring terminals 23 on the contactor housing 21 to form the working loop. In an embodiment of the present invention, the coil 22 is wound around the iron core 24 of the contactor 20. When the coil 22 is energized (or de-energized), magnetic force is produced (or disappears) to drive (or attract) the iron core 24 to perform reciprocating movement (when the coil 22 is de-energized, the coil 22 is driven by a releasing spring), so that the moving and the fixed contacts 28 and 29 in the contactor 20 are connected to switch on the switch mechanism 26 or disconnected to switch off the switch mechanism 26. The switch mechanism 26 is in a connected state or in an opened state to switch on or switch off the working loop.

The control circuit 10 comprises a controller 15, an iron core position sensing circuit 16, a selection circuit 17, a working control circuit 18 and an I/O bus 19 (such as an LIN bus and the like). The controller 15 is provided with an MCU (micro control unit) or other control units. The iron core position sensing 16 is connected to the coil 22 in the contactor 20 and comprises an excitation signal generating circuit 162 and a sensing circuit 164. The working control circuit 18 is connected to the coil 22 in the contactor 20 and comprises a PWM (pulse width modulation) power-saving circuit 184 and a power supply management circuit 182. The controller 15 is connected with all of the iron core position sensing circuit 16, the selection circuit 17 and the working control circuit 18, and is used for controlling the working state of the iron core position sensing circuit 16, the selection circuit 17 and the working control circuit 18 and the signal communication among them. The iron core position sensing circuit 16 and the working control circuit 18 are connected to the contactor 20 through the selection circuit 17. The I/O bus 19 is connected with the controller 15 to realize high-speed communication of the contactor 20, the controller 15, the selection circuit 17, the iron core position sensing circuit 16, the working control circuit 18 and the like to the external.

The selection circuit 17 is connected with the iron core position sensing circuit 16 and the working control circuit 18. The selection circuit 17 selects the working control circuit 18 (in the working state) or the iron core position sensing circuit 16 (in a detection state) to connect with the coil 22 at different time according to a command of the controller 15. For example, when the working control circuit 18 needs to enter the working state, the selection circuit 17 connects the working control circuit 18 with the coil 22 and disconnects the iron core position sensing circuit 16 from the coil 22. The controller 15 commands the working control circuit 18 to supply power to the coil 22 to switch on the working loop such that the coil 22 is energized to produce the magnetic force to drive the iron core 24 to move to connect the moving contacts 28 and the fixed contacts 29 (as shown in FIG. 3A and FIG. 3B) in the contactor 20. As a result, the switch mechanism 26 is a connected state to switch on the working loop for working.

When the iron core position sensing circuit 16 enters the detection state for detecting the position of the iron core 24, the selection circuit 17 disconnects the working control circuit 18 from the coil 22 and connects the iron core position sensing circuit 16 with the coil 22 to form a loop between the coil 22 and the sensing circuit 164; at this time, the controller 15 commands the excitation signal generating circuit 162 to generate a pulse detection signal to send to the coil 22, then the sensing circuit 164 detects the pulse detection signal (the excitation signal) returned from the coil 22 and determines whether the inductance of the coil 22 changes or not based on the returned pulse detection signal and thus determines whether the position of the iron core 24 of the contactor 20 changes or not.

Figure 2:
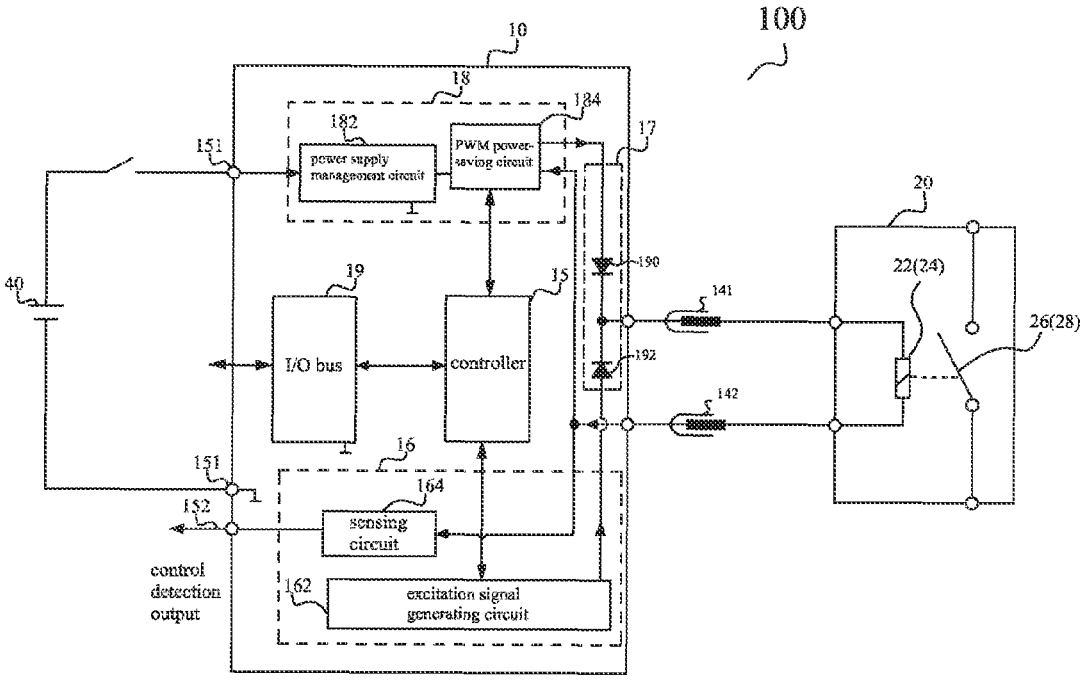
FIG. 2 is a schematic diagram of a circuit structure of a contactor 20 in the second embodiment of the invention.

In the working state, the controller 15 instructs the selection circuit 17 to connect the working control circuit 18 with the coil 22 but disconnect the iron core position sensing circuit 16 from the coil 22. The working control circuit 18 and the coil 22 are connected to form the loop. At the instant of energizing the iron core 24, the controller 15 commands the power supply management circuit 182 to output a starting current signal with a preset duty ratio to the coil 22 through the PWM power-saving circuit 184 to drive the iron core 24 so as to connect the contactor 20 to a high-voltage working loop. After that, the controller 15 commands the power supply management circuit 182 to provide a working current with a smaller stable duty ratio through the PWM power-saving circuit 184 to keep the contactor 20 in the connected state. The power supply management circuit 182 controls the working state of the PWM power-saving circuit 184 in the process, and meanwhile, effectively supply the power from a power supply port 151 (as shown in FIG. 2, the power is provided by a working power supply 40) to the PWM power-saving circuit 184 to enable the PWM power-saving circuit 184 to work according to the command of the controller 15. The contactor 20 in the working state does not need a high-energy electric signal to maintain the connected state, and the contactor 20 can work for a long time with the working current which has a duty ratio smaller than that of the starting current, thus the energy consumption being reduced and the power being saved.

In the working state, in the working process of the contactor 20, long-term high-voltage energization may cause welding adhesion of the moving contacts 28 at the distal ends of the iron core 24 to the pair of the fixed contacts 29. Due to such a welding adhesion, after the driving current is cut off, the coil 22 is thus de-energized and the magnetic force subsequently disappears, the iron core 24 cannot move back to an original position and thus the contactor 20 fails. In another situation, the contactor 20 is also in an abnormal position if the iron core 24 does not return to the original position because it is clamped in the moving path although the moving contacts 28 and the pair of the fixed contacts 29 are not adhered. In the two situations, as the position of the iron core 24 has changed relative to the initial position, the coefficient of self-induction of the coil 22 changes relative to that of the coil in the initial position.

In the detection state, the controller 15 instructs the selection circuit 17 to connect the iron core position sensing circuit 16 with the coil 22 but disconnect the working control circuit 18 from the coil 22. The excitation signal generating circuit 162 is connected with the coil 22 and the sensing circuit 164 to form a loop. The excitation signal generating circuit 162 outputs an excitation signal to the coil 22, thereby the coil 22 generating an inductance; and the sensing circuit 164 measures an inductance value fed back by the coil 22. The inductance values generated by the coil 22 varies with the different positions of the iron core 24; and the sensing circuit 164 determines the positions of the iron core 24 based on different inductance values and sends the determined different position states to the controller 15 for outputting via the I/O bus or via a control detection output end 152.

The principle for position detection for the iron core 24 is as follows: when the iron core 24 is in an abnormal position (including adhesion), because the position is different from the initial position, the coefficient of self-induction of the coil 22 changes. That is to say, the coil 22 generates an inductance value different from that of the coil 22 in the initial position. The time for charging and discharging the coil with different inductance values is different. The excitation signal generating circuit 162 outputs the excitation signal to the coil 22 to charge the coil 22. As the self-induction coil 22 can discharge, the sensing circuit 164 can determine the self-inductance value of the coil by receiving the time for charging and discharging the coil 22 once. The position of the iron core 24 can be determined by comparing the different inductance values. In this process, an external working power supply 40 (as shown in FIG. 2) is used for providing power. The controller 15 supplies the power from the working power supply 40 to the coil 22 in the form of the excitation signal by controlling the excitation signal generating circuit 162.

Figure 6:
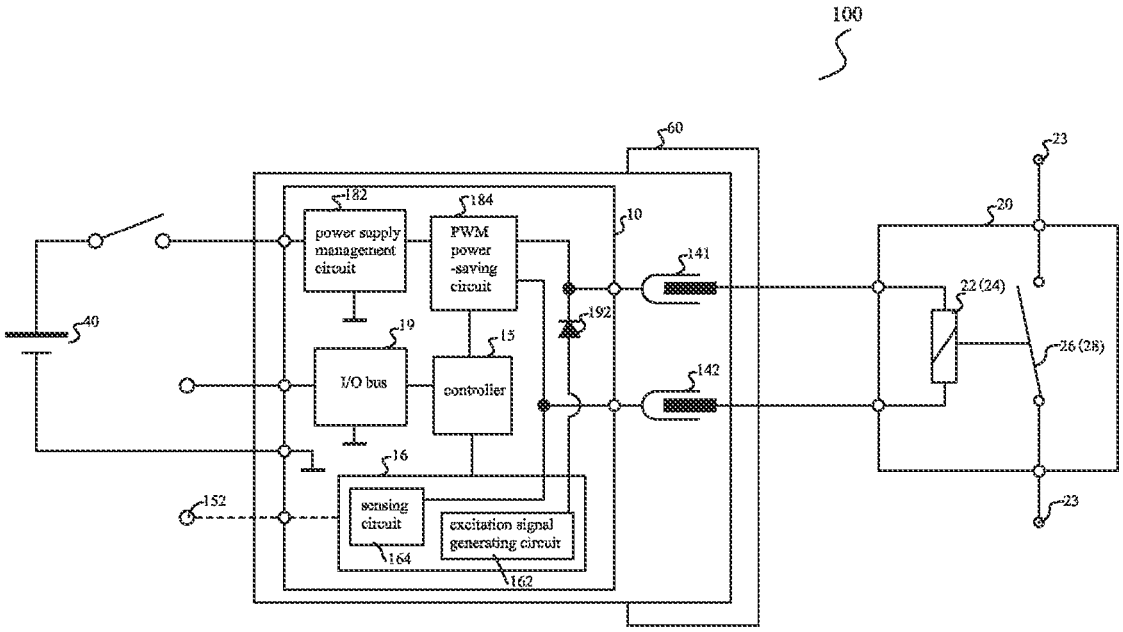
FIG. 6 is a schematic diagram of a circuit structure of a contactor assembly 100 in the third embodiment of the invention.

In FIG. 1, the I/O bus 19, the controller 15, the contactor 20, the selection circuit 17, the iron core position sensing circuit 16, the working control circuit 18, etc. included in the control circuit 10 are all arranged on a printed circuit board. The printed circuit board is mounted on the connector 60 (as shown in FIG. 6), and the control circuit 10 is connected with the coil 22 of the contactor 20 through plugs (such as 141 and 142 as shown in FIG. 2 and FIG. 6). Actually, other types of communication bus protocols, such as a CAN bus, are also applicable.

In the prior art, due to the limitations from the difficulty (cost) in opening a mold of the contactor and the limitations from a chip technology, all the control circuits are integrated in the contactor, which results in a larger size of the contactor, the poor heat dissipation and the electromagnetic interference on the control circuits from the internal energized coil. With a breakthrough in the mold opening process and the development of the chip technology and to comply with the trend of the design of the contactor, the working control circuit is arranged in the connector. With such an arrangement, the electromagnetic interference on the working circuit in the contactor is avoided, the limited space of the contactor is released, the physical limitation of the contactor is reduced, the heat dissipation is enhanced, the size of the contactor is simultaneously reduced, and the water-proof performance is strengthened. More importantly, different functions which need to be customized are integrated on connectors, while the appearance and the model of contactors are unified to meet the demands of different manufacturers.

FIG. 2 is a schematic diagram of a circuit structure of a contactor 20 in the second embodiment of the invention.

As shown in FIG. 2, the contactor (or relay) 20 comprises a control circuit 10 connected with the contactor 20. The control circuit 10 is connected with the coil 22 of the contactor 20 through plugs (141 and 142). The control circuit 10 comprises a controller 15, an iron core position sensing circuit 16, a selection circuit 17, a working control circuit 18, an I/O bus 19, a working power supply 40, etc. The contactor 20, the controller 15, the iron core position sensing circuit 16, the working control circuit 18, the I/O bus 19 and the working power supply 40 have the same structures and the functions as those in the first embodiment and will not be described herein.

The structure and the operation mode of the selection circuit 17 are different from those in the first embodiment: the structure of the selection circuit 17 is that it comprises a first diode 190 and a second diode 192. The first diode 190 is connected between an output end of a PWM power-saving circuit 184 and an input end of the coil 22. Specifically, a positive end of the first diode 190 is connected with the output end of the PWM power-saving circuit 184, and a negative end of the first diode 190 is connected with the input end of the coil 22; the second diode 192 is connected between the iron core position sensing circuit 16 and the input end of the coil 22. Specifically, the positive end of the second diode 192 is connected with the output of an excitation signal generating circuit 162, and the negative end of the second diode 192 is connected with the input end of the coil 22; and the output end of the coil 22 is connected with both of the input end of the PWM power-saving circuit 184 and the input end of the sensing circuit 164.

The working state of the second embodiment is different from that of the first embodiment in FIG. 1. In the second embodiment, the iron core position sensing circuit 16 and the working control circuit 18 are controlled to connect with the coil 22 at different time by utilizing the unidirectional conduction property of the diode. The details are discussed in the below.

Firstly, when the coil 22 needs to enter a working state, the working loop should be switched on. The controller 15 sends a command to the working control circuit 18, and then a power supply management circuit 182 controls the PWM power-saving circuit 184 to send starting current with a preset duty ratio to start the contactor 20. At this moment, the starting current flows from the output end of the PWM power-saving circuit 184 to the input end of the coil 22 sequentially through the positive end of the first diode 190 and the negative end of the first diode 190. As the negative end of the second diode 192 is connected with the coil 22, the starting current does not flow to the excitation signal generating circuit 162; and the starting current flows to the coil 22 through the plug 141 and then flows back to the input end of the PWM power-saving circuit 184 via the plug 142 to form a loop. After the iron core 24 is driven to close the working loop, the controller 15 commands the working control circuit 18 to change (reduce) the duty ratio of the current output from the PWM power-saving circuit 184, thereby saving power. When the working loop needs to be switched off, the controller 15 sends a command to the working control circuit 18, and then the power supply management circuit 182 controls the PWM power-saving circuit 184 to stop providing the current to the coil. In other words, the working control circuit 18 stops working. As a result, the driving force to the iron core 24 disappears and the iron core 24 is pushed back (by a spring), and then the moving and fixed contacts 28 and 29 are disconnected to switch off the working loop.

However, when the iron core position sensing circuit 16 needs to enter a detection state, the controller 15 commands the excitation signal generating circuit 162 to send an excitation signal to the coil upon the working control circuit 18 stops supplying the power. The excitation signal flows into the positive end of the second diode 192 and then to the input end of the coil 22 via the negative end. As the negative end of the first diode 190 is connected with the input end of the coil 22, the excitation signal does not flow to the PWM power-saving circuit 184 via the first diode 190. The excitation signal flows by the coil 22 through the plug 141 and then flows back to the input end of the sensing circuit 164 to form the loop. The sensing circuit 164 senses the time for charging and discharging the coil 22 to determine the position of the iron core 24. A position signal is fed back to the controller 15 in the form of a detection state output and is further communicated to an external vehicle ECU through the I/O bus 19. In the second embodiment, two unidirectional diodes are adopted to replace the selection circuit 17 in the first embodiment to directly control the iron core position sensing circuit 16 and the working control circuit 18 to work at different times. The structure of the second embodiment is simpler, and the manufacturing cost is lower.

Like in the first embodiment, the control circuit 10 of the second embodiment is also arranged on a printed circuit board. The printed circuit board is mounted on a connector 60 (as shown in FIG. 6) and is connected with the coil 22 of the contactor 20 through the plugs (141 and 142). The connector 60 can adopt a variety of structures and can load different functional circuits (or modules) based on different demands. Generally, a sealed or non-sealed disassemble plug-in piece with a built-in printed circuit board is adopted. The plug-in piece is required to large enough to accommodate the required PCB.

FIG. 3A and FIG. 3B are schematic diagrams of an internal structure of the contactor 20 of the present invention. As shown in FIG. 3A-FIG. 3B, the contactor 20 comprises a housing 21 and an iron core 24. The iron core 24 is arranged in a piston 25 to move up and down (reciprocatingly) and is wound with a coil 22 on the periphery. A control circuit 10 (as shown in FIGS. 1-2) is connected with the coil 22 through leads 30. The iron core 24 is configured with a switch mechanism 26 at the distal end, which has a pair of moving contacts 28 on one side. A pair of fixed contacts 29 corresponding to the moving contacts 28 are arranged in a working loop. Wiring terminals 23 (as shown in FIG. 6) are configured on the housing 21 to communicate with the fixed contacts 29 for externally connecting with the working loop.

As shown in FIG. 3A, when the working current flows through the coil 22, the coil 22 produces a magnetic field. The iron core 24 is driven by the magnetic attraction force to move upwardly to connect the moving contacts 28 with the fixed contacts 29. That is to say, when the coil 22 is energized, the iron core 24 moves toward the fixed contacts 29 to connect the moving contacts 28 with the fixed contacts 29. As a result, the working loop controlled by the contactor 20 is switched on.

As shown in FIG. 3B, when the coil 22 is de-energized with removing working current, the iron core 24 moves away from the fixed contacts 29 to disconnect the moving contacts 28 from the fixed contacts. 29. As a result, the working loop controlled by the contactor 20 is switched off. Long-term energization of the working loop can cause the adhesion of the moving contacts 28 (and the iron core 24) to the fixed contacts 29. Due to the adhesion, when the coil 22 is de-energized, the coil 22 cannot return to the normal position, and thus the working loop cannot be switched off and the contactor 20 fails. Actually, the situation that the iron core 24 does not completely return to an initial position not for the reason that the iron core 24 is adhered can be also detected with the excitation signal generating circuit 162 and the sensing circuit 164 which are connected with the coil 22.

Figure 4A:
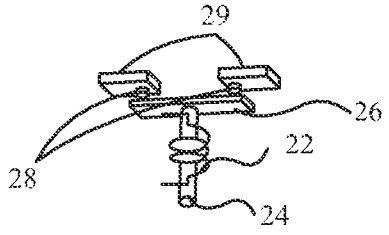
FIG. 4A is a schematic diagram of the positions of the contacts when the moving and the fixed contacts of the contactor 20 are not adhered.

FIG. 4A is a schematic diagram of positions of contacts where the contacts of the contactor 20 are not adhered. As shown in FIG. 4A, the contactor 20 comprises an iron core 24, a coil 22 wound around the iron core 24, a switch mechanism 26 configured at the distal end of the iron core 24 and a pair of moving contacts 28 on one side of the switch mechanism 26. A pair of fixed contacts 29 corresponding to the moving contacts 28 are arranged on the working loop. When the working loop is required to be switched on, the iron core 24 moves to connect the moving contacts 28 with the fixed contacts 29 so that the working loop is closed through the switch mechanism. Long-term energization of the working loop will cause the moving contacts 28 to adhere to the fixed contacts 29 and thus the moving contacts 28 cannot be disconnected from the fixed contacts 29. As a result, the working loop cannot be switched off and thus the contactor fails. In the figure, the fixed contacts 29 are not adhered to the moving contacts 28. Therefore, after the de-energization of the coil 22, the iron core 24 returns to the initial position, which drives the switch mechanism 26 to return to the initial position, such that the moving contacts 28 are disconnected from the pair of fixed contacts 29 on the side of the controlled device.

Figure 4B:
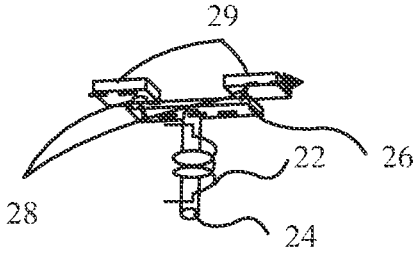
FIG. 4B is a schematic diagram of the positions of the contacts after the moving and the fixed contacts of the contactor 20 are adhered.

FIG. 4B is a schematic diagram of the positions of the contacts after the contacts of the contactor 20 are adhered. As shown in FIG. 4B, the moving contacts 28 and the fixed contacts 29 are adhered. Therefore, after de-energization of the coil 22, the iron core 24 cannot return to the initial position. Thus, the moving contacts 28 and the pair of fixed contacts 29 on the side of the controlled device are still connected together and the current still flows through the working loop. Therefore, the contactor 20 fails.

Figure 5:
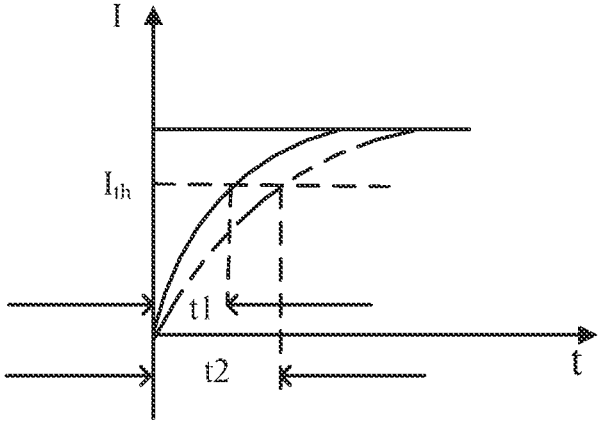
FIG. 5 is a schematic diagram of two charging curves of the coil 22 respectively when the iron core 24 is in a normal position as shown in FIG. 4A and in an abnormal position as shown in FIG. 4B.

FIG. 5 is a schematic diagram of two charging curves of the coil 22 respectively when the iron core 24 is in a normal position as shown in FIG. 4A and in an abnormal position as shown in FIG. 4B.

The present invention can use a variety of methods for measuring inductance. In this embodiment, the inductance is measured by measuring time for charging and discharging the coil. As shown in FIG. 5, in a normal state of the iron core 24 as shown in FIG. 4A, the iron core 24 can return to a normal position where the coefficient of self-induction of the coil 22 is larger, the current changes more slowly, and the measured time for charging the coil 22 is t2, which can be set as a desired value. As shown in FIG. 4B, when the moving contacts 28 are adhered, the coefficient of self-induction of the coil 22 is smaller, the current changes faster, and the measured time for charging the coil 22 is t1. If the time for charging the coil 22 in the normal state of the moving contacts 28 is t2 and set as the desired value, the measured time t1 for charging the coil 22 is compared with the desired charging time t2. If t1 is equivalent to t2 or t1 is in a predetermined range of the desired value, it is judged that the moving contacts 28 are not adhered to the fixed contacts and the iron core 24 is in the normal state. If t1 is different from the desired value or exceeds the predetermined range of the desired value, it is judged that the position of the iron core 24 is in an abnormal state. If the difference between t1 and t2 is the maximum, it can be determined that the moving contacts 28 are adhered to the fixed contacts. If the difference between t1 and t2 is less than the maximum, it can be determined that the iron core 24 does not return to the initial position, but the adhesion does not occur.

The present invention utilizes the character of the coefficient of the self-induction of the coil that it varies with different insertion positions of the iron core to sense the position of the iron core. Furthermore, the present invention designs a position sensing circuit which is simple and easy to operate and suitable for expansion, so that not only the manufacturing cost and the maintenance cost of the contactor are reduced, but also the connector can be configured with an electronic power-saving function on the basis of the circuit, the level triggering of the contactor or the control drive of an LIN bus (or other communication buses) is realized, thus facilitating the application for customers.

FIG. 6 is a schematic diagram of a circuit structure of a contactor assembly 100 in the third embodiment of the invention.

As shown in FIG. 6, the contactor assembly 100 comprises a contactor 20 and a connector 60 connected with the contactor 20. The contactor 20 comprises a coil 22, an iron core 24, a switch mechanism 26 and wiring terminals 23. A control circuit 10 (as shown in FIGS. 1-2) is connected with the coil 22 through leads 30. In (on or inside) the connector 60, the control circuit 10 comprises a power supply management circuit 182, a PWM power-saving circuit 184, a sensing circuit 164, an excitation signal generating circuit 162, a controller 15, an I/O bus 19, control detection output 152, etc. The control circuit 10 is detachably connected with the coil 22 of the contactor 20 through plug-in pieces 141 and 142. The control circuit 10 is arranged on a printed circuit board, and the printed circuit board is mounted on the connector 60. The connector 60 can adopt a variety of structures and can load different functional circuits (or modules) according to different demands. Generally, a sealed or non-sealed separable plug-in piece with the built-in printed circuit board is adopted. The plug-in piece is required to large enough to accommodate the required PCB.

For those of ordinary skill in the art, various changes and variations can be made to the embodiments described in the invention without deviating from the spirit and the scope of the present invention. Thus, the description aims at covering the various changes and variations, if such changes and variations are in the scope of accompanying claims and equivalents thereof.

What is claimed is:

1. A control circuit for controlling operation of a contactor, the contactor having an iron core and a coil which is wound around the iron core, wherein the control circuit comprises an iron core position sensing circuit and a working control circuit, the iron core position sensing circuit comprises:

an excitation signal generating circuit, which is connected with the coil and is capable of outputting an excitation signal to the coil and enabling the coil to generate an inductance, wherein the coil is capable of generating inductance values varying with different positions of the iron core; and a sensing circuit, which is connected with the coil and measures the inductance values produced by the coil by measuring charging and discharging time, the sensing circuit determining the positions of the iron core according to different inductance values by measuring a charging and discharging time difference generated by a variation in the inductance produced by the coil; and the working control circuit provides a working current to the coil to drive the iron core to move back and forth.

2. The control circuit according to claim 1, wherein the working control circuit is connected with the coil and provides the working current to the coil to close the contactor to switch on a working loop; and wherein the excitation signal generating circuit outputs the excitation signal to the coil when the working loop is in a switched-off state.

3. The control circuit according to claim 2, further comprising a selection circuit, wherein the selection circuit is connectable with the iron core position sensing circuit and the working control circuit;

when the selection circuit and the working control circuit are connected, the contactor is kept in a connected state; and when the selection circuit and the iron core position sensing circuit are connected, the iron core position sensing circuit senses a change in the inductance value of the coil to determine the position of the iron core.

4. The control circuit according to claim 1, wherein the measured inductance values are compared with a desired value, when a measured inductance value is equal to the desired value or is within a predetermined range of the expected value, it is determined that the iron core is in a normal position; and when a measured inductance value is different from the desired value or exceeds the predetermined range of the desired value, it is determined that the iron core is in an abnormal position.

5. The control circuit according to claim 1, wherein the excitation signal generating circuit is used for sending the excitation signal when the coil changes from an energized state to a de-energized state; and the sensing circuit is used for determining the position of the iron core when the coil changes from the energized state to the de-energized state.

6. A contactor assembly comprising:

a contactor comprising a coil and an iron core, the coil being wound around the iron core, a control circuit according to claim 1, the control circuit being connected with the coil, and a connector, wherein the control circuit is arranged on the connector and connected with the connector as a single piece.

7. The contactor assembly according to claim 6, wherein the iron core is configured with a switch mechanism at a distal end of the iron core, and a pair of moving contacts are configured on one side of the switch mechanism;

when the coil is energized, the iron core moves to a pair of fixed contacts to connect with the fixed contacts;

when the coil is de-energized, the iron core moves away from the fixed contacts to disconnect from the fixed contacts;

the sensing circuit determines whether the iron core and the moving contacts are in an abnormal position or in a normal disconnected position based on the inductance changing amount of the coil.

8. A connector comprising a control circuit connectable to a coil in a contactor for controlling operation of the contactor, the control circuit comprising a working control circuit for providing a working current to the contactor, wherein the working control circuit comprises a PWM power-saving circuit for connecting with the contactor;

when the contactor is being connected, the PWM power-saving circuit provides a signal with a preset duty ratio to the contactor; and after the contactor is connected, the PWM power-saving circuit provides a signal with a smaller duty ratio to the contactor to maintain a connected state of the contactor, thereby reducing power consumption;

a controller connected with the control circuit for controlling the operation of the control circuit;

an iron core position sensing circuit for producing a signal sensing a position of an iron core in the contactor;

a selection circuit connected with the controller and controlled by the controller; and an I/O bus connected with the controller to enable the controller to communicate with an external circuit;

wherein the controller processes the signal generated by the iron core position sensing circuit which indicates the sensed position of the iron core, to generate a signal indicating a position state of the iron core and output the signal indicating the position state of the iron core through the I/O bus; and wherein the selection circuit is connected with the coil, and with the iron core position sensing circuit and the working control circuit, so that the selection circuit selects the iron core position sensing circuit or the working control circuit to connect with the coil at different times.

9. The connector according to claim 8, wherein the iron core position sensing circuit comprises:

an excitation signal generating circuit, which is connected with the coil and is capable of outputting an excitation signal to the coil and enabling the coil to generate an inductance, wherein the coil is capable of producing inductance values varying with different positions of the iron core; and a sensing circuit connected with the coil for measuring an inductance value generated by the coil, wherein the sensing circuit determines the different positions of the iron core based on the different inductance values.

10. The connector according to claim 9, wherein the controller controls the excitation signal generating circuit and outputs the excitation signal to the coil when a working loop is switched off.

11. The connector according to claim 10, wherein a desired inductance value is stored in the sensing circuit;

the measured inductance value is compared with the desired value, wherein if the measured inductance value is equal to the desired value or is in a predetermined range of the desired value, it is determined that the iron core is in a normal position; and wherein if the measured inductance value is different from the desired value or exceeds the predetermined range of the desired value, it is determined that the iron core is in an abnormal position;

the sensing circuit measures the inductance value of the coil to further determine the position of the iron core by measuring the charging and discharging time; and the sensing circuit measures a charging and discharging time difference formed due to a variation in inductances generated by the coil to determine the position of the iron core.

12. The connector according to claim 8, wherein the control circuit is arranged on a printed circuit board, the printed circuit board being mounted on the connector;

the control circuit is detachably connected with the coil through the connector; and the connector is connected with the coil through plug-in pieces.

13. The connector according to claim 8, wherein the iron core position sensing circuit comprises:

an excitation signal generating circuit, which is connected with the coil and is capable of outputting an excitation signal to the coil and enabling the coil to generate an inductance, wherein the coil is capable of generating inductance values varying with different positions of the iron core; and a sensing circuit, which is connected with the coil and measures the inductance values produced by the coil, the sensing circuit determining the positions of the iron core according to different inductance values.

14. The contactor assembly according to claim 13, wherein the contactor comprises a contactor housing configured with wiring ends for connecting to a working loop.

15. The contactor assembly according to claim 14, wherein the iron core is configured with a pair of moving contacts at a distal end of the iron core, and the working loop is configured with a pair of fixed contacts;

when the coil is energized, the iron core moves to the pair of fixed contacts to connect with the fixed contacts; and when the coil is de-energized, the iron core moves away from the fixed contacts to disconnect from the fixed contacts.

16. A contactor assembly comprising a contactor with a coil and a connector according to claim 8, wherein the control circuit is connected with the coil.

17. The contactor assembly according to claim 16, wherein the contactor comprises an iron core configured with a switch mechanism at the distal end; and the coil is wound around the iron core and is used for driving the iron core to move back and forth so as to close or open the switch mechanism to switch on or switch off the working loop.

18. The contactor assembly according to claim 17, wherein the sensing circuit determines that the iron core and the moving contacts are in abnormal positions or in a normal position disconnected from the fixed contacts based on the variation in the inductance of the coil, and in the abnormal position of the iron core and the moving contacts, the moving contacts are adhered with the fixed contacts.

* * * * *